US007940286B2

(12) United States Patent
Pan et al.

(10) Patent No.: US 7,940,286 B2
(45) Date of Patent: May 10, 2011

(54) DISPLAY HAVING CONTROLLABLE GRAY SCALE CIRCUIT

(75) Inventors: Mingchia Pan, Tainan (TW); Mingjhen Sie, Tainan County (TW); Chincheng Tsai, Kaohsiung (TW)

(73) Assignee: Chimei Innolux Corporation, Miao-Li County (TW)

( * ) Notice: Subject to any disclaimer, the term of this patent is extended or adjusted under 35 U.S.C. 154(b) by 967 days.

(21) Appl. No.: 11/273,249

(22) Filed: Nov. 14, 2005

(65) Prior Publication Data

US 2006/0132406 A1 Jun. 22, 2006

(30) Foreign Application Priority Data

Nov. 24, 2004 (TW) ..... 93136205 A

(51) Int. Cl.
*G09G 5/10* (2006.01)
*G09G 3/36* (2006.01)

(52) U.S. Cl. ..... 345/690; 345/89

(58) Field of Classification Search ..... 345/89, 345/88, 96, 95, 690
See application file for complete search history.

(56) References Cited

U.S. PATENT DOCUMENTS 5,402,142 A 3/1995 Okada et al.
5,796,379 A * 8/1998 Enomoto et al. ..... 345/89
6,441,763 B1 * 8/2002 Nakao ..... 341/154
7,307,610 B2 12/2007 Sakaguchi
2002/0015014 A1 * 2/2002 Sakashita ..... 345/87
2002/0163490 A1 * 11/2002 Nose ..... 345/89
2002/0186231 A1 * 12/2002 Kudo et al. ..... 345/690
2003/0006952 A1 * 1/2003 Hong ..... 345/89
2003/0122761 A1 * 7/2003 Hong ..... 345/89
2003/0151577 A1 * 8/2003 Morita ..... 345/89
2003/0234800 A1 * 12/2003 Nakajima et al. ..... 345/690
2004/0075631 A1 * 4/2004 Ishiguchi ..... 345/96
2004/0227775 A1 * 11/2004 Shimizu et al. ..... 345/690
2004/0246216 A1 * 12/2004 Hosaka ..... 345/87
2005/0007393 A1 * 1/2005 Akai et al. ..... 345/690
2005/0017992 A1 * 1/2005 Kudo et al. ..... 345/690
2005/0057482 A1 * 3/2005 Youngblood et al. ..... 345/100

FOREIGN PATENT DOCUMENTS

CN 1453758 A 11/2003
JP 2004-126293 4/2004
TW I227456 8/2003
TW I234759 6/2005

OTHER PUBLICATIONS

Hiroaki Sakai, "Office Action", including English Abstract thereof, Japanese Patent Application No. 2005-336631, 6 pages, Feb. 15, 2011.

* cited by examiner

*Primary Examiner* — Chanh Nguyen
*Assistant Examiner* — Robert M Stone
(74) *Attorney, Agent, or Firm* — Fish & Richardson P.C.

(57) ABSTRACT

A display that includes a circuit to receive pixel data and to generate a first set of gray-scale voltages based on the first set of reference voltages to drive pixel circuits to display respectively different gray-scale levels during a first time period in accordance with the pixel data, and generate a second set of gray-scale voltages based on a second, different set of reference voltages to drive the pixel circuits to display a common gray-scale level during a second time period. For example, the common gray-scale level can be a black level.

40 Claims, 11 Drawing Sheets

102 104 130

| Data | Dx5-Dx0 | Output Voltage |
|---|---|---|
| 00H | 000000 | V0 |
| 01H | 000001 | V1 |
| 02H | 000010 | V2 |
| 03H | 000011 | V3 |
| 04H | 000100 | V4 |
| 05H | 000101 | V5 |
| 06H | 000110 | V6 |
| 07H | 000111 | V7 |
| 08H | 001000 | V8 |
| 09H | 001001 | V9 |
| 0AH | 001010 | V10 |
| 0BH | 001011 | V11 |
| 0CH | 001100 | V12 |
| 0DH | 001101 | V13 |
| 0EH | 001110 | V14 |
| 0FH | 001111 | V15 |
| 10H | 010000 | V16 |
| 11H | 010001 | V17 |
| 12H | 010010 | V18 |
| 13H | 010011 | V19 |
| 14H | 010100 | V20 |
| 15H | 010101 | V21 |
| 16H | 010110 | V22 |
| 17H | 010111 | V23 |
| 18H | 011000 | V24 |
| 19H | 011001 | V25 |
| 1AH | 011010 | V26 |
| 1BH | 011011 | V27 |
| 1CH | 011100 | V28 |
| 1DH | 011101 | V29 |
| 1EH | 011110 | V30 |
| 1FH | 011111 | V31 |
| 20H | 100000 | V32 |
| 21H | 100001 | V33 |
| 22H | 100010 | V34 |
| 23H | 100011 | V35 |
| ⋮ | ⋮ | ⋮ |

FIG. 6

DISPLAY HAVING CONTROLLABLE GRAY SCALE CIRCUIT

CROSS-REFERENCE TO RELATED APPLICATIONS

This application claims priority to Taiwan application serial no. 93136205, filed Nov. 24, 2004, the content of which is incorporated by reference.

BACKGROUND OF THE INVENTION

This description relates to a display having a controllable gray scale circuit.

Referring to FIG. 1, in some examples, a liquid crystal display 10 includes an array 12 of pixel circuits 14 that are controlled by one or more gate drivers 16 and one or more data drivers 18. Each pixel circuit 14 includes one or more thin film transistors (TFT) 20, a storage capacitor $C_{ST}$ 22, and a liquid crystal cell (not shown in the figure). The liquid crystal cell has an effective capacitance, represented by $C_{LC}$ 25. The capacitors $C_{ST}$ 22 and $C_{LC}$ 25 are connected to a first node 21 and a second node 23. In some examples, the first node 21 is connected to the transistor 20, and the second node 23 is connected to a reference voltage Vcom. The TFT 20 includes a gate 24 that is connected to a gate line 26, which is connected to the gate driver 16. When the gate driver 16 drives the gate line 26 to turn on the TFT 20, the data driver 18 simultaneously drives a data line 28 with a voltage signal, which is passed to the capacitors $C_{ST}$ 22 and $C_{LC}$ 25.

The first and second nodes 21 and 23 are connected to two transparent electrodes (not shown), respectively, that are positioned on two sides of the liquid crystal cell. The voltage held by the capacitors $C_{ST}$ 22 and $C_{LC}$ 25 determines the voltage applied to the liquid crystal cell, which controls the amount of change in the orientations of liquid crystal molecules in the cell and determines the amount of light that can pass through the cell. The voltage on the data line 28 is sometimes referred to as a "gray scale voltage" because it determines the gray scale level shown by the pixel circuit 14.

Each pixel on the display 10 includes three sub-pixels for displaying red, green, and blue colors. Each sub-pixel includes a pixel circuit 14. By controlling the gray scale levels of the three sub-pixels, each pixel can display a wide range of colors and gray scale levels.

The relationship between the voltage applied to the liquid crystal cell and the transmittance of the cell can be non-linear. FIG. 2 is a graph that shows a curve 150 representing a relationship between the gray scale voltage V (received on the data line 28) applied to the first node 21 of the storage capacitor 22 and the transmittance of the liquid crystal cell. The curve 150 is approximately symmetrical with respect to V=Vcom (which is the reference voltage applied to the second node 23 of the capacitor 22). When the gray scale voltage is equal to Vcom (zero voltage difference across the capacitor), there is a high transmittance. When the gray-scale voltage is above Vref1 or below Vref2, the transmittance is near zero. Vref1−Vcom is approximately equal to Vcom−Vref2. The transmittance of the liquid crystal cell is affected by the absolute voltage difference applied to the liquid crystal cell, regardless of the polarity of the voltage difference (positive polarity refers to the voltage at an upper electrode being greater than the voltage at a lower electrode, and negative polarity refers to the voltage at the upper electrode being smaller than the voltage at the lower electrode). In some examples, the voltage applied to the liquid crystal cell alternates in polarity (that is, the voltage on data line 28 alternates between Vcom+ΔV and Vcom−ΔV) to reduce stress imparted on the liquid crystal cell.

The data drivers 18 (FIG. 1) receive pixel data from a display controller 30, which in turn receives image or video signals from a host device 32, such as a host computer. When the display 10 is initially powered on, leakage currents from the TFTs 20 of the pixel circuits 14 may cause the data drivers 18 to drive the pixel circuits 14 before receiving pixel data from the display controller 30. When power is initially supplied to the data drivers 18, the initial states of different data drivers 18 may be different, because the data drivers 18 may have residual voltages associated with a previous image frame that was displayed prior to turning off the display 10. Even when the backlight module of the display is not turned on, ambient light may be reflected from the display, and the data drivers 18 may drive the pixel circuits 14 using the residual voltages causing the display 10 to show vertical gray stripes or bands for a short period of time before the controller 30 is initialized.

SUMMARY OF THE INVENTION

In one aspect, in general, an apparatus includes a circuit to receive pixel data and to generate a first set of gray-scale voltages based on the first set of reference voltages to drive pixel circuits to display respectively different gray-scale levels during a first time period in accordance with the pixel data, and a second set of gray-scale voltages based on a second, different set of reference voltages to drive the pixel circuits to display a common gray-scale level during a second time period.

Implementations of the apparatus may include one or more of the following features. The circuit includes one or more data drivers that drive data lines using the first and second sets of gray-scale voltages, in which the data lines are coupled to the pixel circuits. The circuit includes a voltage divider coupled to a switch that is switched between the first period and the second period. The voltage divider includes resistive elements connected in series. When the switch is turned on, the voltage divider provides an electrical path between a first node and a second node, the first node providing a first input voltage, the second node providing a second input voltage, the voltage divider dividing a voltage difference between the first input voltage and the second input voltage to generate the first set of reference voltages. In some examples, the first input voltage is higher than the second input voltage, and the switch is coupled between the first node and the voltage divider, such that when the switch is turned off, the voltage divider outputs reference voltages that are equal to the first input voltage. In some examples, the first input voltage is higher than the second input voltage, and the switch is coupled between the second node and the voltage divider, such that when the switch is turned off, the voltage divider outputs reference voltages that are equal to the second input voltage. In some examples, the switch is coupled between a first portion of the voltage divider and a second portion of the voltage divider, such that when the switch is turned off, the first portion of the voltage divider outputs reference voltages that are equal to the first input voltage and the second portion of the voltage divider outputs reference voltages that are equal to the second input voltage. The second input voltage includes ground voltage. The common gray-scale level includes a black level. The circuit includes a voltage divider that is coupled to a first switch and a second switch, one of the first and second switches being turned on during the first period, and both of the first and second switches being turned off during the second period. When the first switch is turned on and the second switch is turned off, the voltage divider divides a first voltage difference to generate the first set of reference voltages that have a first set of values, and when the first switch is turned off and the second switch is turned on, the voltage divider divides a second voltage difference to generate the first set of reference voltages that have a second set of values. The circuit receives pixel data for each pixel circuit, selects one of the reference voltages based on the pixel data, and drives the pixel circuit using the selected reference voltage. The apparatus includes at least one of a liquid crystal display, a plasma display, an organic light emitting diode display, a field emission display, and a surface-conduction electron-emitter display, in which the display includes the circuit.

In another aspect, in general, an apparatus includes a circuit to generate reference voltages for use in a first state of the circuit, for generating gray-scale voltages to drive pixel circuits to display respectively different gray-scale levels, and in a second state of the circuit, for generating gray-scale voltages to drive the pixel circuits to display a common gray-scale level.

Implementations of the apparatus may include one or more of the following features. The circuit includes one or more data drivers that drive data lines using the first and second sets of gray-scale voltages, in which the data lines are coupled to the pixel circuits. The circuit operates in the second state during a period after a voltage supply is provided to the data driver and before the data driver receives data signals sent from a host device. When the circuit operates in the first state, the data driver outputs a gray-scale voltage for each pixel circuit based on a data signal from a host device to cause the pixel circuit to display one of the distinct levels of gray-scale. The circuit includes a voltage divider coupled to a switch that controls whether an electric current flows through the voltage divider, in which whether the electric current flows through the voltage divider affects the reference voltages generated by the circuit.

In another aspect, in general, an apparatus includes a circuit to (a) drive a pixel to a gray-scale level using an analog gray-scale voltage that is selected from among a set of analog gray-scale voltages based on received pixel data associated with the pixel, and (b) change the number of different gray-scale voltages from which the analog voltage can be selected during different time periods.

Implementations of the apparatus may include one or more of the following features. During a certain period of time, the set of analog gray-scale voltages have values such that the data driver drives the pixel to display a common gray-scale level regardless of the digital pixel data. The common gray-scale level includes a black level. The certain period of time includes a period of time after a voltage supply is provided to the data driver and before the data driver receives digital pixel data from a host device. During a certain period of time, the set of analog gray-scale voltages all have a common value. During a certain period of time, the set of analog gray-scale voltages have two common values.

In another aspect, in general, a display includes an array of pixel circuits and a controllable reference voltage generator to generate a first set of reference voltages during a first time period and a second set of reference voltages during a second time period. The controllable reference voltage generator includes a voltage divider coupled to a switch that is switched between the first period and the second period, the voltage divider dividing a voltage difference during the first time period to generate the first set of reference voltages. The display includes one or more data drivers to receive pixel data from a host device and to generate a first set of gray-scale voltages based on the first set of reference voltages to drive the pixel circuits to display respectively different gray-scale levels during the first time period in accordance with the pixel data, and generate a second set of gray-scale voltages based on the second set of reference voltages to drive the pixel circuits to display a common gray-scale level during the second time period.

Implementations of the apparatus may include one or more of the following features. The common gray-scale level includes a black level. The pixel circuits include at least one of liquid crystal cells, plasma discharge elements, organic light emitting diodes, field emission elements, and surface-conduction electron-emitters.

In another aspect, in general, a method includes causing pixels of a display to show a common gray-scale level at times when pixel data is being received that would otherwise cause the pixels to display different gray-scale levels.

Implementations of the method may include one or more of the following features. The method includes controlling reference voltages that are used by one or more data drivers of the display to generate gray-scale voltages for controlling gray-scale displayed by the pixels, in which the controlling includes, during a first time period, setting the reference voltages to one or more values to cause the pixels to display a common gray-scale level independent of the pixel data sent to the one or more data drivers from a host device. Setting the reference voltages to one or more values includes setting the reference voltages to a common value that is higher than a ground reference voltage. Setting the reference voltages to one or more values includes setting the reference voltages to a common value that is lower than a ground reference voltage. Setting the reference voltages to one or more values includes setting the reference voltages to two common values, one being higher than a ground reference voltage and the other being lower than the ground reference voltage. The method includes, during a second time period, setting the set of reference voltages to distinct values to cause the pixels to display distinct levels of gray-scale based on the pixel data sent to the one or more data drivers from the host device. The method includes, during the second time period, dividing a voltage difference between a first input voltage and a second input voltage to generate the reference voltages. In some examples, the method includes, during the first time period, setting the reference voltages to be equal to the first input voltage, the first input voltage being higher than the second input voltage. In some examples, the method includes, during the first time period, setting the reference voltages to be equal to the second input voltage, the first input voltage being higher than the second input voltage. In some examples, the method includes, during the first time period, setting some of the reference voltages to be equal to the first input voltage and setting the other of the reference voltages to be equal to the second input voltage. The method includes setting the set of reference voltages to one or more particular values to cause the pixels to display a black image. Controlling the set of reference voltages includes controlling a switch to determine whether an electric current flows through a voltage divider. Controlling the switch includes turning off the switch during the first time period to prevent an electric current from flowing through the voltage divider. The method includes dividing a voltage difference between a first input voltage and a second input voltage to generate the reference voltages.

In another aspect, in general, a method includes generating an image having a uniform gray-scale level on a display by controlling gray-scale voltages used to drive pixel circuits of the display, the controlling of the gray-scale voltages being independent of pixel data sent by a host device to the display.

Implementations of the method may include the following feature. The image includes a black image.

In another aspect, in general, a method includes providing gray-scale voltages on signal lines; for each pixel of a display, selecting one of the signal lines and use the gray-scale voltage on the selected signal line to determine a gray-scale level for the pixel; and during a first time period, controlling the gray-scale voltages provided on the signal lines to cause the pixels to show a common gray-scale level.

Implementations of the method may include one or more of the following features. The image includes a black image. Controlling the gray-scale voltages includes controlling one or more switches to affect the values of the gray-scale voltages. The method includes using a voltage divider to generate the gray-scale voltages that are provided on the signal lines. Controlling the gray-scale voltages includes controlling one or more switches to connect or disconnect the voltage divider from input voltages. Controlling the one or more switches includes connecting the voltage divider to a first input voltage and disconnecting the voltage divider from a second input voltage to cause the outputs of the voltage divider to be equal to the first input voltage. The method includes, during a second time period, controlling the gray-scale voltages provided on the signal lines to cause the pixels to show distinct gray-scale levels. Selecting one of the signal lines includes selecting one of the signal lines based on pixel data sent from a host device.

In another aspect, in general, a method includes generating a black image on a display during a certain period of time by controlling reference voltages that are used by one or more digital-to-analog devices of the display to generate analog gray-scale voltages for determining the gray-scale levels shown by pixels of the display.

Implementations of the method may include one or more of the following features. The certain period of time includes a period of time after a voltage supply is provided to one or more data drivers of the display and before the data driver receives digital pixel data from a host device. Generating the black image includes generating a black image during a period of time after a voltage supply is provided to the one or more data drivers and before the data driver receives digital pixel data from a host device.

An advantage of using the circuits described above to generate common gray-scale images or black images is that the host device (such as a host computer) does not have to send extra signals for generating the common gray-scale images or black images. The common gray-scale images or black images can be generated simply by turning on or off one or more switches in the circuit.

DESCRIPTION OF DRAWINGS

FIG. 6 shows a chart.

DESCRIPTION

By controlling reference voltages that are used to generate gray-scale voltages, the data drivers 18 can be controlled to output one or two gray-scale voltages regardless of the values of the pixel data. This causes the display 10 to show an image having a common gray-scale at all pixels, such as a black image. The black image can be shown between normal image frames to reduce blurring in motion images, or be shown before the controller 30 is initialized so that the display 10 shows a uniform black image when the display 10 is initially powered on.

Figure 3:
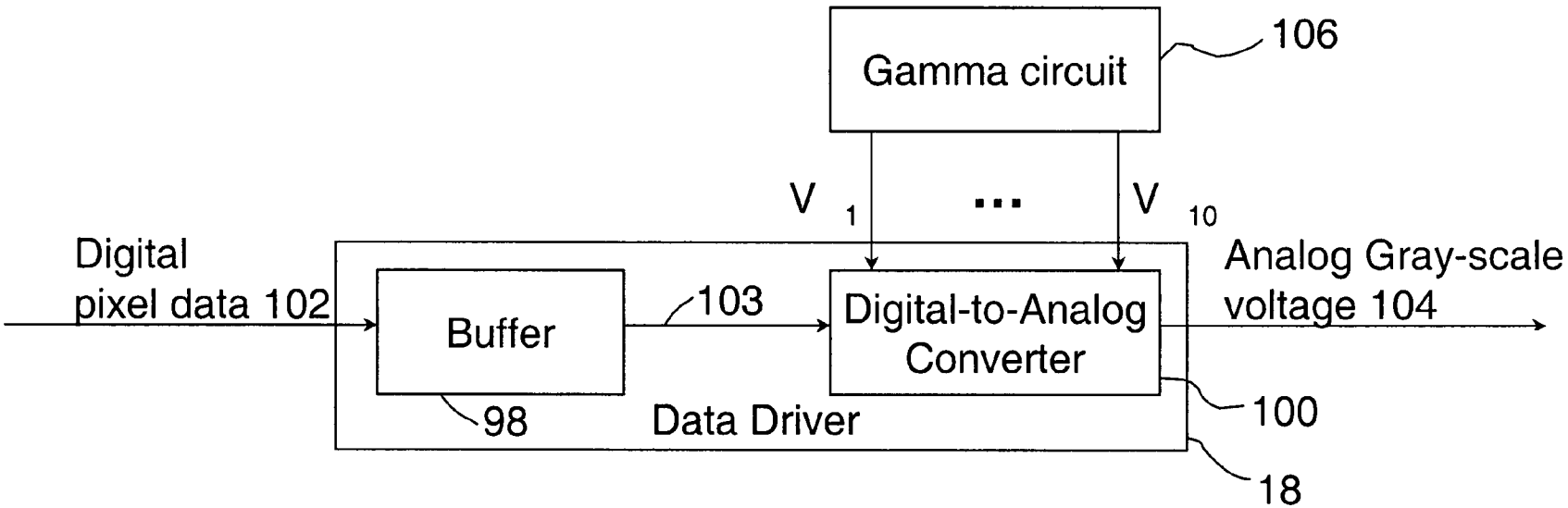
FIGS. 3-5 are schematic diagrams.

Referring to FIG. 3, in one example, the data driver 138 includes a buffer 98 and a digital-to-analog converter 100. The buffer 98 receives serial digital pixel data 102 from the display controller 30, and converts the serial digital pixel data 102 into parallel data 103. The digital-to-analog converter 100 receives the parallel data 103 and outputs an analog gray-scale voltage 104 that is used to drive the data line 28. The digital-to-analog converter 100 also receives reference voltages, referred to as gamma voltages Vγ1 to Vγ10, from a gamma circuit 106, in which the gamma voltages are used in determining a mapping between the digital pixel data 102 and the analog gray-scale voltage 104.

Figure 4:
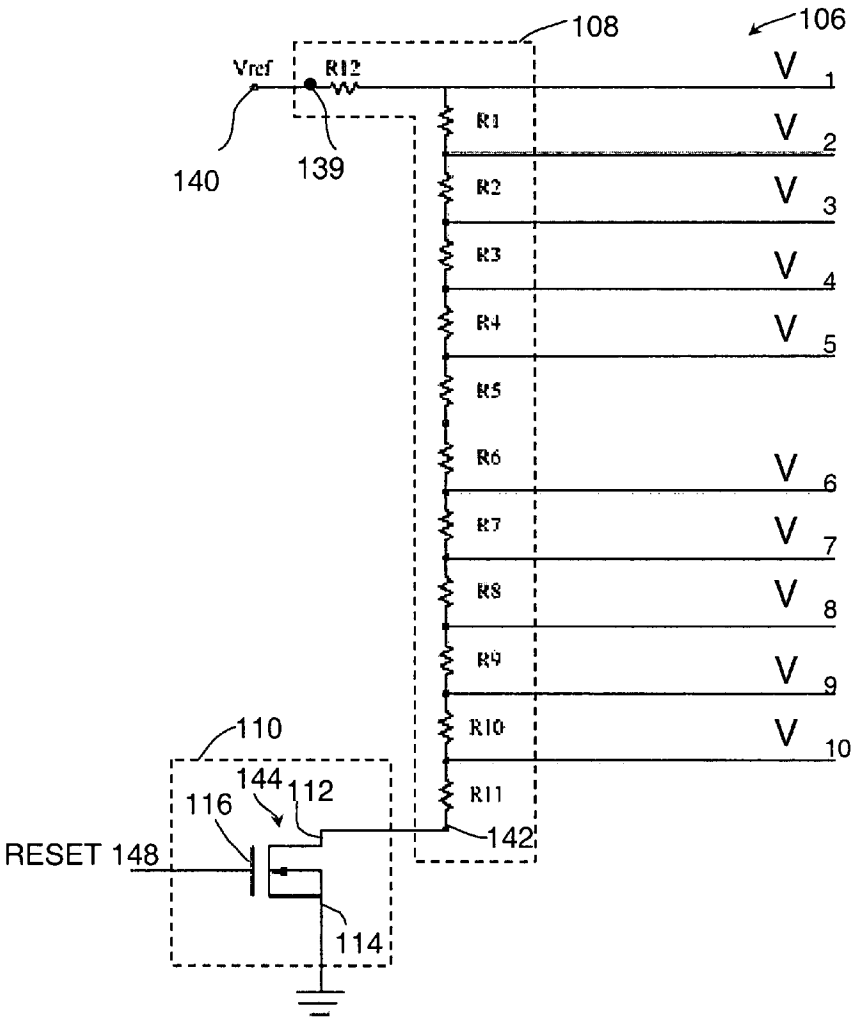

Referring to FIG. 4, in some examples, the gamma circuit 106 includes a voltage divider 108 and a switch 110. One end 139 of the voltage divider 108 is connected to a node 140 that receives an input voltage Vref, and another end 142 of the voltage divider 108 is connected to the switch 110. In some examples, the switch 110 is an N-type MOSFET transistor 144 having a drain 112 connected to the node 142, a source 114 connected to ground, and a gate 116 that is controlled by a RESET signal 148.

The voltage divider 108 includes a resistor ladder having resistors R1 to R12 that are connected in series. When the RESET signal 148 is high, the transistor 144 is turned on, providing an electrical path from node 140 to ground through the voltage divider 108 and the switch 110. The voltage divider 108 divides the input voltage Vref to generate ten gamma voltages Vγ1 to Vγ10 that have ten different values that are determined based on the ratios of the resistors. When the RESET signal 148 is low, the transistor 144 is turned off, causing the drain 112 to "float." Because the voltage divider 108 is connected to the input voltage Vref, the drain 112 is pulled high, and the gamma voltages Vγ1 to Vγ10 all become equal to Vref. Thus, by using the RESET signal 148 to control the switch 110, and by providing a Vref voltage at the other end of the voltage driver, the gamma voltages can be controlled to have ten distinct values or just one common value.

Figure 5:
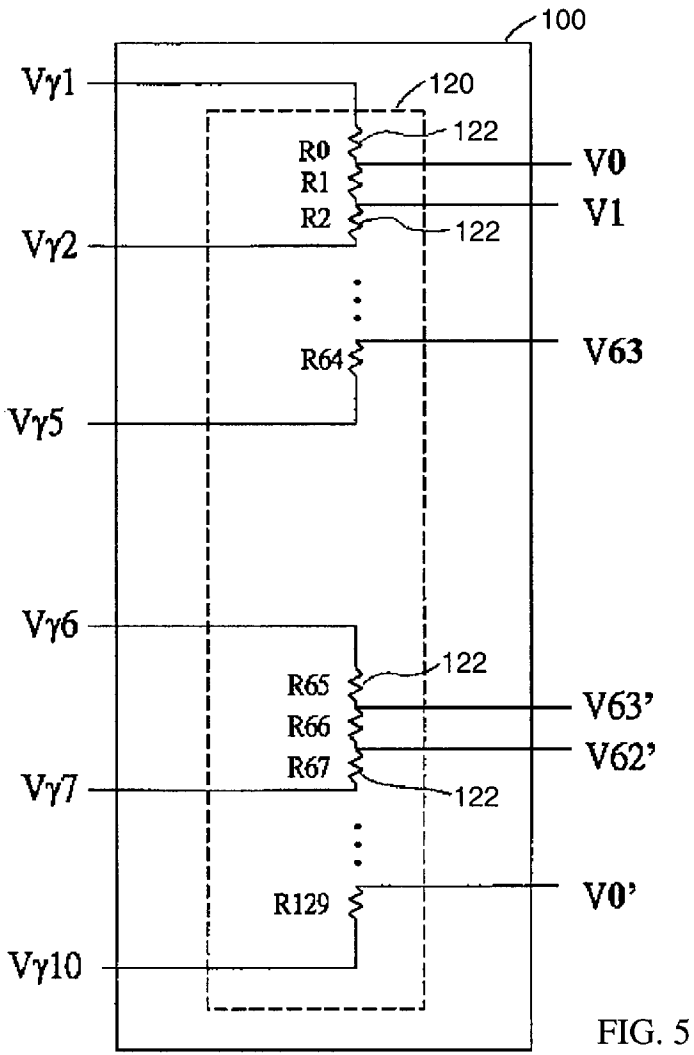

Referring to FIG. 5, the digital-to-analog converter 100 includes another voltage divider 120 having a resistor ladder to further divide the gamma voltages Vγ1 to Vγ10 to generate the gray-scale voltages. In this example, the voltage divider 120 generates 128 gray-scale voltages V0 to V63 and V63' to V0'. The voltage divider 120 includes a resistive ladder having resistors 122, whose resistance values are selected to produce a predetermined mapping between the pixel data 102 and the gray-scale voltages. In some examples, the predetermined mapping may be selected to offset the non-linear responses of the liquid crystal cells such that the images shown on the display 10, when perceived by a viewer, have accurate gray-scales.

When the switch 110 is turned on (RESET signal 148 is high), the gray-scale voltages V0 to V63 and V63' to V0' will have 128 distinct values, ranging from Vγ1 to Vγ10. This allows the data driver 18 to drive the pixel circuits with 128 distinct gray-scale voltages, which includes 64 positive polarity gray-scale voltages and 64 negative polarity gray-scale voltages, allowing the display 10 to show images having 64 distinct levels of gray-scale. The number of gray-scale levels that can be shown on the display is half the number of distinct gray-scale voltages because applying gray-scale voltages Vcom+ΔV and Vcom−ΔV to the liquid crystal cell will result in the same gray-scale level (see FIG. 2). The resistance values of the resistors 122 are selected so that, applying V0 to the pixel circuit 14 will result in the same luminance as applying V0' to the pixel circuit 14. Similarly, applying V1 or V1' to the pixel circuit 14 will result in the same luminance.

When the switch 110 is turned off (RESET signal 148 is low), the gamma voltages all have a common value equal to Vref, so the gray-scale voltages V0 to V127 will also have a common value that is equal to Vref. Regardless of the value of the pixel data, the data driver 18 will drive the pixel circuits 14 using the common gray-scale voltage, namely, Vref, so that the display 10 will show an image having a common gray-scale level. In this example, the value of Vref is selected such that applying Vref to the first node 21 of the capacitor 22 results in zero (or close to zero) transmittance of the liquid crystal cell. Thus, when the switch 110 is turned off, the display 10 will show a uniform black image.

FIG. 6 shows a chart 130 showing the relationships between the digital pixel data 102 and the analog gray-scale voltages 104. In this example, the pixel data 102 is a 6-bit binary data, and the digital pixel data 00H, 01H, 02H correspond to gray-scale voltages V0, V1, and V2, respectively. In some examples, gray-scale voltages of alternating polarities are used to drive the pixels to reduce stress on the liquid crystal cells. Thus, for example, if the pixel data is 00H, the data driver 16 will drive the data line 28 using V0 and V127 alternately. As another example, if the pixel data is 05H, the data driver 16 will drive the data line 28 using V5 and V122 alternately.

Figure 7:
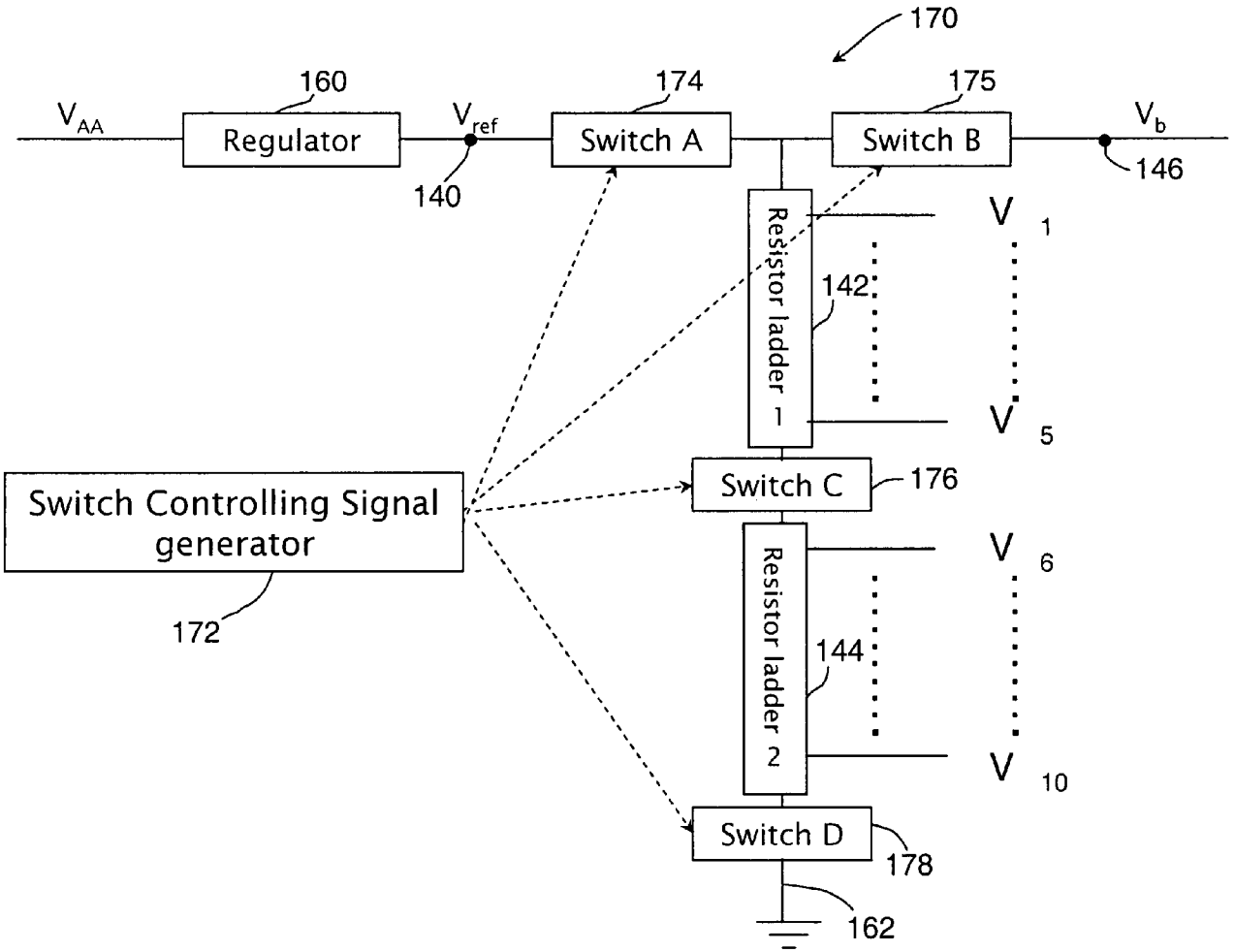
FIGS. 7 and 8 are schematic diagrams.

Referring to FIG. 7, in some examples, a gamma circuit 170 may include more than one switch, such as switch A 174, switch B 175, switch C 176, and switch D 178, that are controlled by a switch control signal generator 172. A voltage regulator 160 receives a power supply voltage $V_{AA}$ and generates a voltage Vref on a node 140. Switch A 174 is connected between the node 140 and a first resistor ladder 142. Switch B 175 is connected between the first resistor ladder 142 and a node 146, which receives a voltage Vb. Switch C 176 is connected between the first resistor ladder 142 and a second resistor ladder 144. Switch D 178 is connected between the second resistor ladder 144 and a node 162 coupled to ground voltage.

When switches A, C, and D are turned on, and switch B is turned off, an electrical path is established from the node 140 to ground through switch A, the first resistor ladder 142, switch C, and the second resistor ladder 144. The first resistor ladder 142 is disconnected from the node 146. The first and second resistor ladders 142 and 144 divide the voltage difference between Vref and ground, such that the first resistor ladder 142 generates five distinct gamma voltages: Vγ1 to Vγ5, and the second resistor ladder 144 generates five distinct gamma voltages: Vγ6 to Vγ10. Here, the range of gamma voltages depends on Vref and the resistor values in the first and second resistor ladders 142 and 144.

The ten distinct gamma voltages Vγ1 to Vγ10, when further divided by the voltage divider 120 of the digital-to-analog converter 100, produce 128 distinct gray-scale voltages that can be used to drive the pixel circuits 14 to display 64 distinct gray-scale levels.

Similarly, when switches B, C, and D are turned on, and switch A is turned off, an electrical path is established from the node 146 to ground. The first resistor ladder 142 is disconnected from the node 140. The first and second resistor ladders 142 and 144 divide the voltage difference between Vb and ground, such that the first and second resistor ladders 142 and 144 generate ten distinct gamma voltages: Vγ1 to Vγ10. Here, the rage of gamma voltages depend on Vb. The ten distinct gamma voltages Vγ1 to Vγ10 can be further divided by the voltage divider 120 to generate 128 distinct gray-scale voltages, which can be used to show 64 distinct levels of gray-scale.

By selectively turning on switch A or switch B, two gamma profiles can be obtained. For example, this may allow a user to select different mappings between the digital pixel data and the luminance of pixels.

When switches B and D are turned off, and switches A and C are turned on, the first and second resistive ladders 142 and 144 float to Vref so that all of the gamma voltages Vγ1 to Vγ10 become equal to Vref. Because the gray-scale voltages V0 to V127 are derived from Vγ1 to Vγ10, V0 to V127 all become equal to Vref. In this case, regardless of the values of the pixel data 102, the data drivers 18 will drive the pixel circuits 14 using Vref as the gray-scale voltage, so that the display 10 will show an image having a uniform black image.

Similarly, when switches A and D are turned off, and switches B and C are turned on, all of the gamma voltages Vγ1 to Vγ10 become equal to Vb. In some examples, Vb is selected such that applying Vb to the first node 21 of the capacitor 22 results in zero (or close to zero) transmittance of the liquid crystal cell. Thus, when switches A and D are turned off, and switches B and C are turned on, regardless of the pixel data 102, the data drivers 18 will drive the pixel circuits 14 using Vb as the gray-scale voltage, so that the display 10 will show a uniform black image.

When switches A and B are turned off, and switches C and D are turned on, the first and second resistor ladders 142 and 144 float to ground, so the gamma voltages Vγ1 to Vγ10 all become equal to ground voltage. As a result, the gray-scale voltages all become equal to the ground voltage. In this case, regardless of the values of the pixel data 102, the data drivers 18 will drive the pixel circuits 14 using ground voltage as the gray-scale voltage, so that the display 10 will show a uniform black image.

When switches B and C are turned off, and switches A and D are turned on, the first resistor ladder 142 floats to Vref, and the second resistor ladder 144 floats to ground. The gamma voltages Vγ1 to Vγ5 become equal to Vref, and the gamma voltages Vγ6 to Vγ10 become equal to the ground voltage. The gray-scale voltages V0 to V63 become equal to Vref, and the gray-scale voltages V64 to V127 become equal to the ground voltage. Regardless of the values of the pixel data 102, the data drivers 18 will drive the pixel circuits 14 alternately using Vref and ground voltage, so that the display 10 will show a uniform black image.

Similarly, when switches A and C are turned off, and switches B and D are turned on, the gamma voltages Vγ1 to Vγ5 will be equal to Vb, and the gamma voltages Vγ6 to Vγ10 will be equal to ground voltage. The gray-scale voltages V0 to V63 will be equal to Vb, and the gray-scale voltages V64 to V127 will be equal to ground voltage. The voltage Vcom is adjusted so that Vb and ground voltage are symmetric with respect to Vcom. Regardless of the pixel data 102, the data driver 18 will drive the pixel circuits 14 alternately using Vb and ground voltage, causing the display 10 to show a uniform black image.

Figure 8:
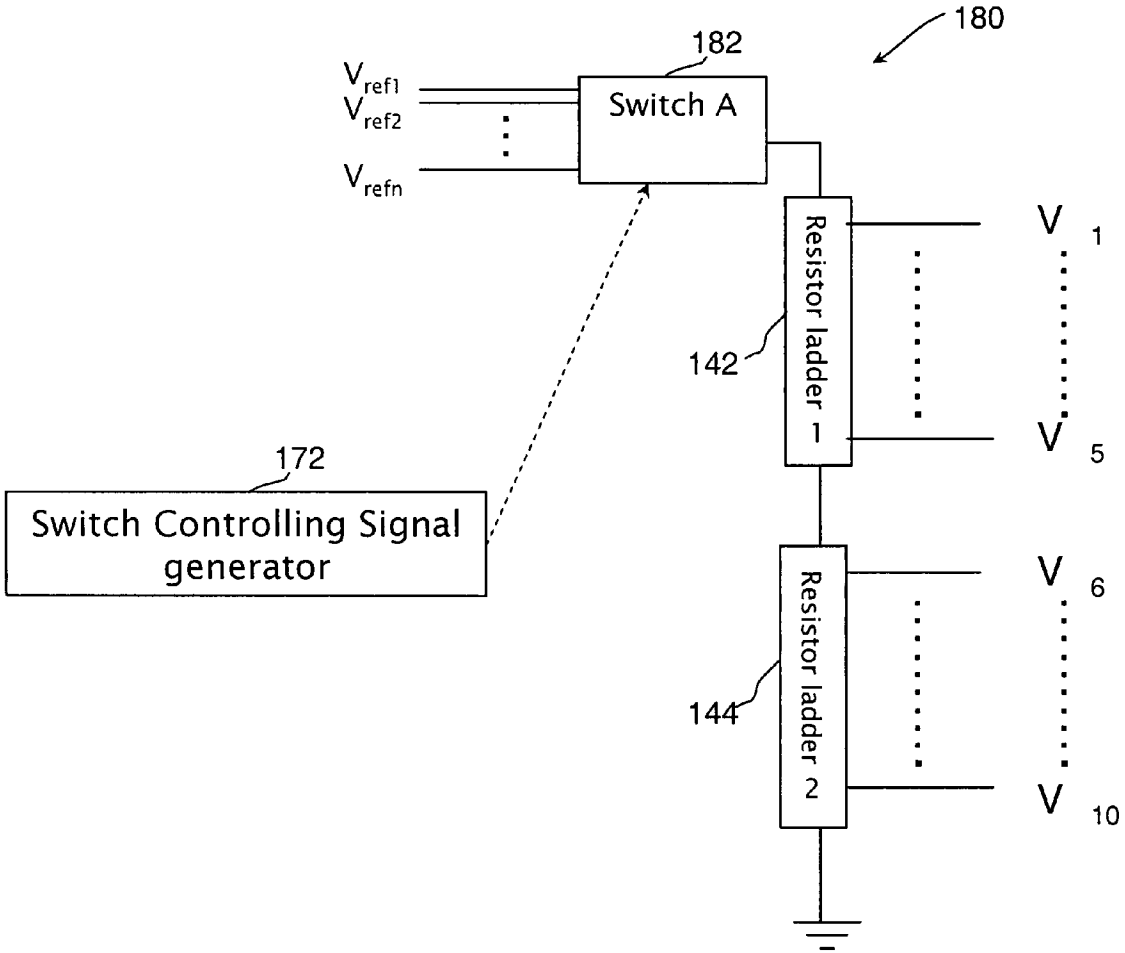

Referring to FIG. 8, in some examples, a gamma circuit 180 includes a switch 182 that can select from among voltages Vref 1, Vref2, . . . , and Vrefn, so that different gamma profiles can be selected through the control of the switch 182. The switch 182 can also be turned off, causing the resistor ladders 142 and 144 to float to ground.

By controlling the switch or switches of the gamma circuit 106 (FIG. 4), 170 (FIG. 7), or 180 (FIG. 8), one can determine whether the display 10 shows a diverse range of gray-scale, or shows a uniform black image. In some examples, the switches are controlled by a timing controller that controls when the gate drivers 16 drive gate lines 26, and when the data drivers 18 drive the data lines 28.

Displaying a black image is useful in erasing a residual image on the display 10. In some examples, video is displayed at 30 frames per second on the display 10, so each frame occupies 33.3 ms. Because the gate driver 16 sequentially drives the gate lines 26 to activate rows of pixels to receive the gray-scale voltages from the data drivers 18, it is possible that a portion (for example, an upper portion of the array 12) of the display 10 shows the image of a new frame, while the remaining portions (for example, a lower portion of the array 12) of the display 10 shows the image of an old frame. When video that includes fast moving objects are shown on the display 10, showing portions of new and old frames at the same time may result in blurring at the edges of the moving objects.

Figure 9:
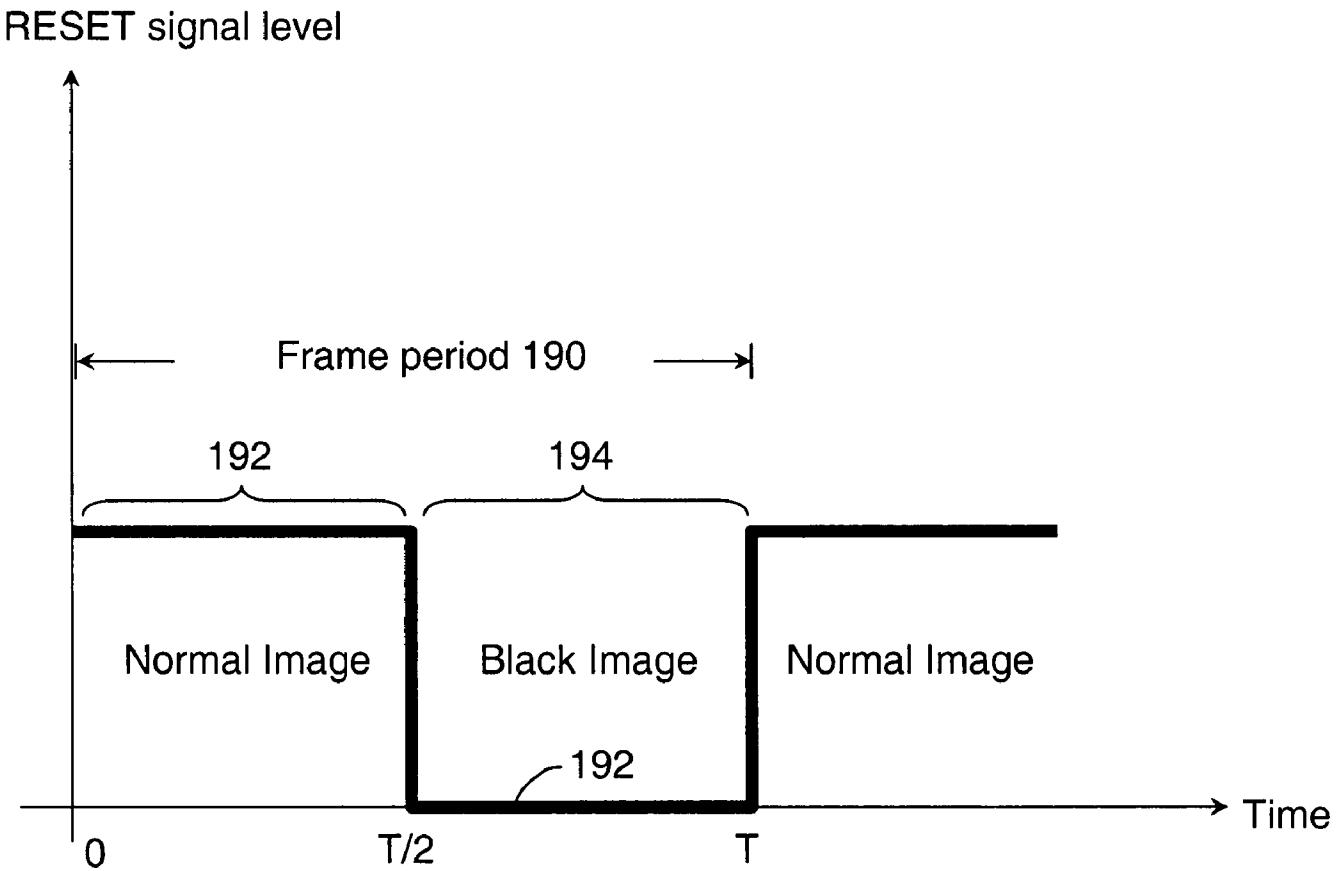
FIGS. 9 and 10 are timing diagrams.

One way to reduce the blurring effect is to insert a black image between two image frames. The following description uses the gamma circuit 106 of FIGS. 3 and 4 as an example. Referring to FIG. 9, in some examples, a frame period 190 of T=33.3 ms is divided into two parts. During a first half 192 of the frame period 190 (such as between t=0 and t=T/2), the RESET signal 148 is pulled high to turn on the switch 110, causing the gamma circuit 106 to output the full range of distinct gamma voltages, so that the pixel circuits 14 can potentially output the full range of gray-scale levels. As the gate driver 16 sequentially activates each row of pixels in the display 10, a normal image is shown on the display 10 based on the pixel data 102 sent from the host device.

During a second half 194 of the frame period 190 (such as between t=T/2 and t=T), the RESET signal 148 is pulled low to turn off the switch 110, causing the gamma circuit 106 to output gamma voltages that have a common value Vref. As the gate driver 16 sequentially activates each row of pixels, the pixels are driven using a gray-scale voltage that equals Vref, causing the row of pixels to become dark. The gate driver 16 sequentially drives the first to the last row of pixels to cause the display 10 to show a uniform black image.

Each pixel displays a normal gray-scale level (that is, the gray-scale of a pixel of a normal image) for the first half 192 of a frame period 190, and displays a black level for a second half 194 of the frame period 190. Each new frame starts with a black background as the rows of pixels are sequentially driven to display the gray-scale levels according to the new frame. Thus, blurring of edges of moving objects in the images can be reduced.

By controlling the switch or switches of the gamma circuit 106, 170, or 180, one can also prevent gray stripes or bands from occurring during a period after power supply is provided to the data driver and before the controller 30 is properly initialized.

Figure 10:
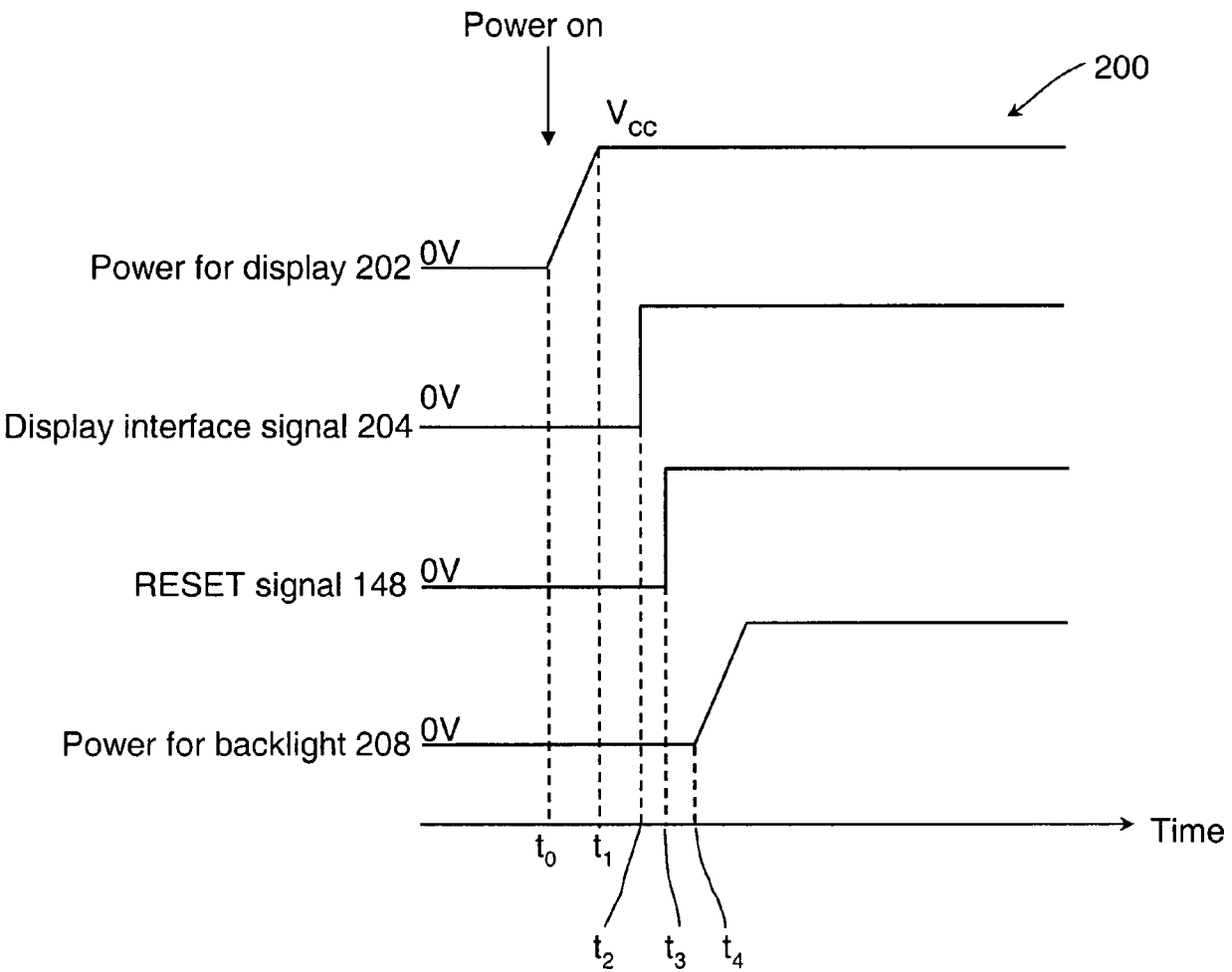

Referring to FIG. 10, a timing diagram 200 shows the relative timing of a power supply voltage 202 for the display 10, display interface signals 204 that include the digital pixel data 102, the RESET signal 148, and a power supply voltage 208 for a backlight module. At time t0, the display 10 is turned on, and the power supply voltage 202 increases from 0V. At time t1, the power supply voltage 202 reaches a preset value Vcc. At time t1, the display interface signals 204, which can be low voltage differential signals and include the digital pixel data 102, are still at low levels. The display interface signals 204 do not become activated until time t2. This means that correct pixel data 102 do not arrive at the data drivers 18 until after time t2.

After the display is turned on, the RESET signal 148 is kept low until a short period of time t3 after t2. Before time t3, the gamma voltages are all equal to Vref, and the gray-scale voltages are all be equal to Vref, so that the display 10 shows a black image. When the RESET signals 148 pulls high at time t3, the data drivers 18 drive the pixel circuits 14 using distinct gray-scale voltages that are derived from the ten distinct gamma voltages Vγ1 to Vγ10, allowing the display 10 to show images having distinct levels of gray-scale. Shortly after time t3, at time t4, the power supply 208 for the backlight module is turned on. The times t2, t3, and t4 can also occur simultaneously.

Using the timing sequence shown in FIG. 10, the display 10 will initially show a uniform black image when powered on, then transition to a correct image associated with the pixel data sent from the host device, without displaying vertical gray stripes or bands on the display 10.

Figure 11:
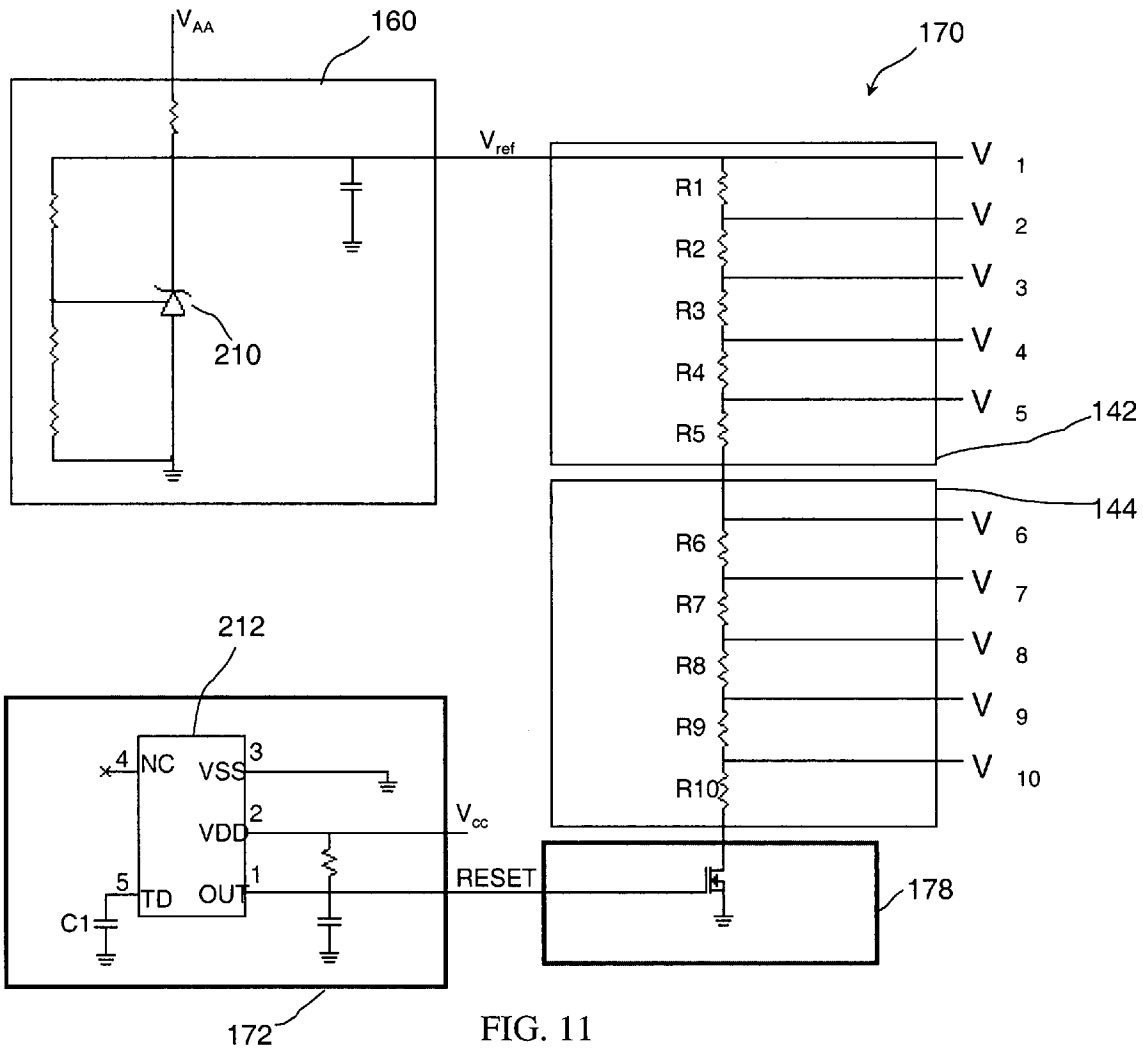
FIG. 11 is a schematic diagram.

FIG. 11 shows an example of the gamma circuit 170 (FIG.7 ) in which only switch D 178 is used. The voltage regulator 160 includes a zener diode 210 that regulates the input voltage $V_{AA}$ to generate the regulated voltage Vref. The switch control signal generator 172 includes a delay circuit 212 that receives a power supply voltage Vcc at pin 2, and after a preset period of time, outputs the power supply voltage at pin 1. The output at pin 1 is used as the RESET signal 148.

When power supply $V_{AA}$ is provided to the gamma circuit 170, the RESET signal 148 is initially low and the switch 178 is turned off, so the gray-scale voltages Vγ1 to Vγ10 are all initially equal to Vref. After a delay period determined by the delay circuit 212, the RESET signal 148 turns high and the switch 178 is turned on, so that the first and second resistor ladders 142 and 144 divide the voltage Vref and generate ten distinct gamma voltages Vγ1 to Vγ10.

Various modifications can be made to the examples described above. For example, the gamma circuit 170 in FIG. 7 does not necessarily have to include all four switches A to D. The gamma circuit 170 can also include any combinations of switches A to D. Additional switches can be used. The black images can be inserted into the normal frames using a method other than those described above, such as the method described in co-pending U.S. patent application Ser. No. 11/256,661, filed Oct. 21, 2005, titled "Liquid Crystal Display and Driving Method Thereof," herein incorporated by reference. Other types of switches can be used, for example, switches that use P-type MOSFET transistors.

The number of gamma voltages, the number of gray-scale voltages, and the number of gray-scale levels that can be shown on the display can be different from those described above. A data driver can have more than one digital-to-analog converter. The display 10 can be another type of display, such as a plasma display, an organic light emitting diode display, a field emission display, or a surface-conduction electron-emitter display. Additional signal processing and control circuitry may be added to the display. The delay period of the switch or switches of the gamma circuit can be fixed or programmable. The resistor values of the voltage dividers, and the configuration of the resistor ladders for dividing the gamma voltages to generate the gray-scale voltages, can be different from those described above. The image that is forced to appear at initialization need not be all black but could be another predetermined image.

The storage capacitor $C_{ST}$ 22 does not necessarily have to be connected to the same reference voltage, Vcom, as the capacitor $C_{LC}$ 25. For example, one node of the storage capacitor $C_{ST}$ 22 can be connected to the TFT 20, and the other node of the storage capacitor $C_{ST}$ 22 can be connected to the another scan line 26 or ground voltage.

Figure 1:
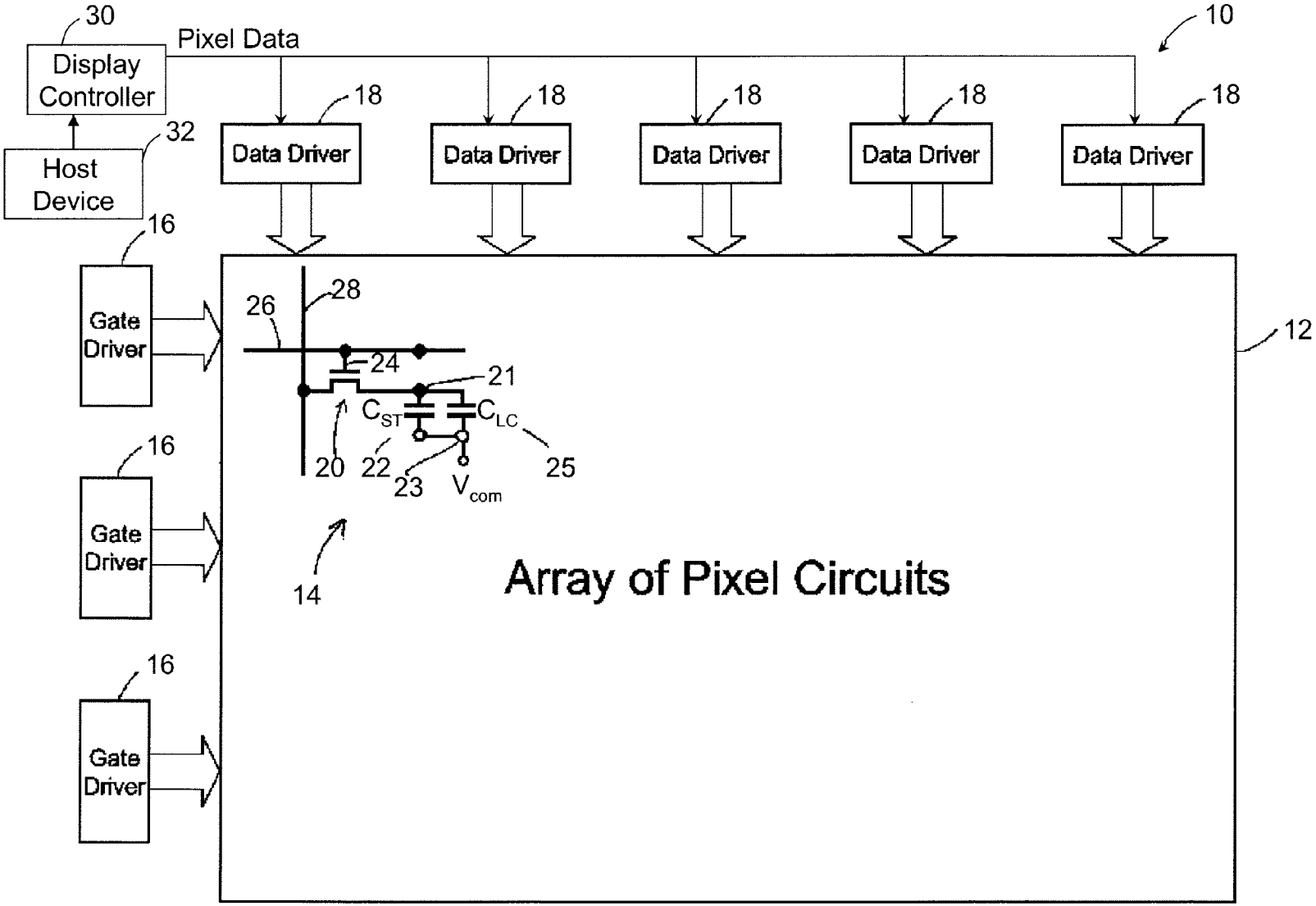
FIG. 1 (Prior Art)
FIG. 1 is a schematic diagram of a liquid crystal display.
Figure 2:
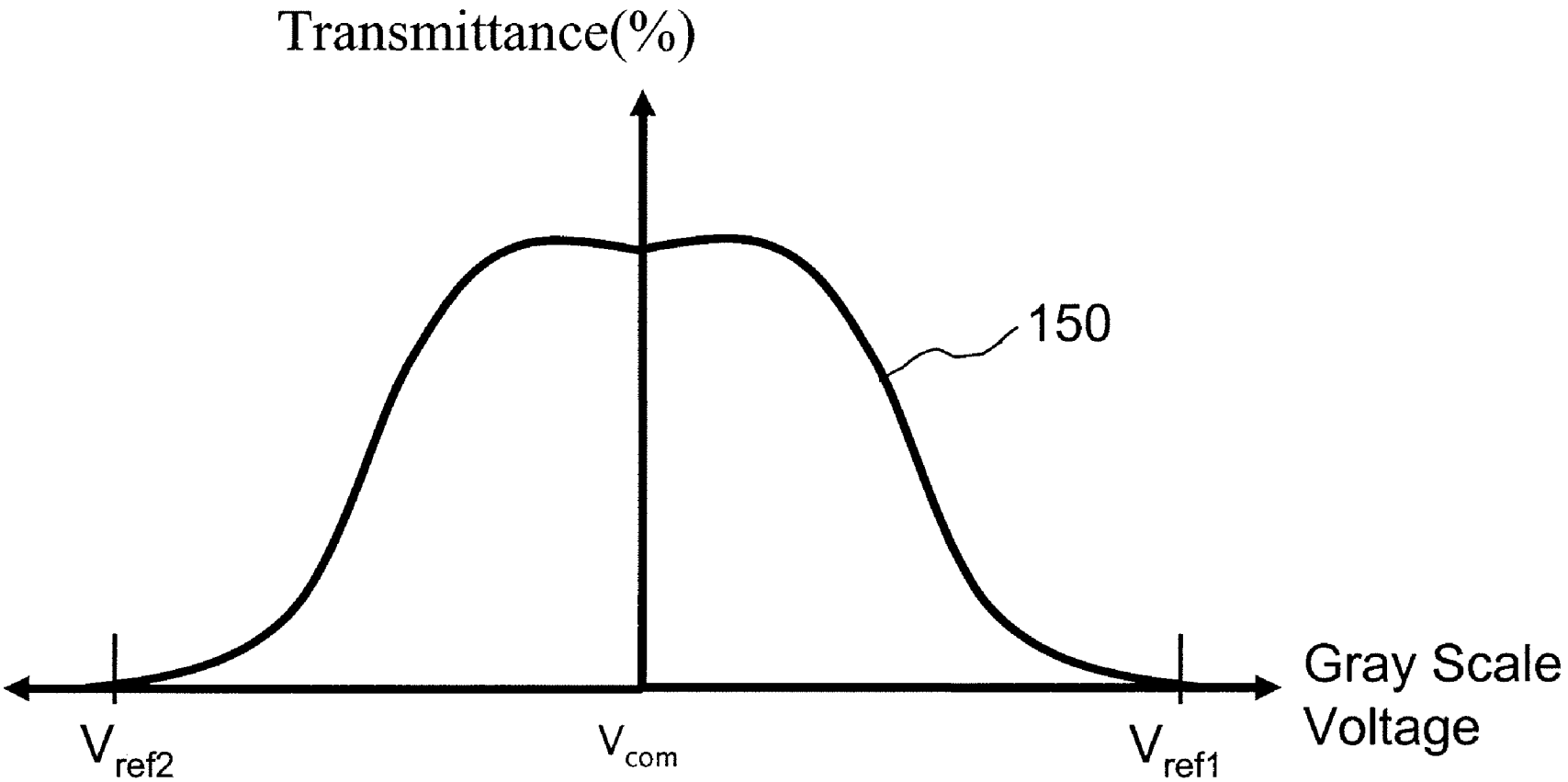
FIG. 2 (Prior Art)
FIG. 2 is a graph.

FIG. 2 shows the transmittance diagram of a "normally white" display, in which the liquid crystal cell allows light to be transmitted through the cell when no voltage is applied to the electrodes of the liquid crystal cell. A "normally black" display can also be used, in which the liquid crystal cell blocks light from being transmitted through the cell when no voltage is applied to the electrodes of the liquid crystal cell.

The switches may be controlled in response to a user command to select different gamma profiles. The switches may also be controlled automatically based on content of the images or video shown on the display. For example, one gamma profile may be selected if the display mainly shows text or still images, and another gamma profile may be selected if the display is showing a video. The switches may also be controlled automatically based on the environment of the display. For example, the display have include sensors to detect the ambient light. Different gamma profiles may be selected based on the ambient light levels such that the images are shown clearly on the display at brightness levels comfortable to the user. Different gamma profiles may also be selected based on the ambient light color tones, such that the images shown on the display are perceived by the user with accurate colors (for example, ambient light form sunlight, incandescent light bulbs, or fluorescent lamps may cause the same image on the display to be perceived differently by the user).

Although some examples have been discussed above, other implementations and applications are also within the scope of the following claims.

What is claimed is:

1. An apparatus comprising:

a digital-to-analog converter (DAC); and a circuit to receive pixel data and to generate a first set of reference voltages using resistive elements connected in series during a first time period, the first set of reference voltages being provided to the DAC for generating gray-scale voltages to drive pixel circuits to display respectively different gray-scale levels according to a first gamma profile during the first time period in accordance with the pixel data, generate a second reference voltage or a second set of reference voltages using the series-connected resistive elements during a second time period, the second reference voltage or second set of reference voltages being provided to the DAC for generating a gray-scale voltage or gray-scale voltages to drive the pixel circuits to display a common gray-scale level during the second time period, and generate a third set of reference voltages using the resistive elements during a third time period, the third set of reference voltages being provided to the DAC for generating gray-scale voltages to drive the pixel circuits to display respectively different gray-scale levels according to a second gamma profile during the third time period in accordance with the pixel data;

wherein switching among driving the pixel circuits to display respective different gray-scale levels according to the first gamma profile, driving the pixel circuits to display the common gray-scale level, and driving the pixel circuits to display respective different gray-scale levels according to the second gamma profile is responsive to switching among providing the first set of reference voltages to the DAC, providing the second reference voltage or second set of reference voltages to the DAC, and providing the third set of reference voltages to the DAC, and wherein the circuit comprises a first switch, a second switch, and a third switch, and the circuit is configured to turn on the first switch, turn off the second switch, and turn on the third switch to cause a first electric current to flow through the first switch, the series of resistive elements, and the third switch to generate the first set of reference voltages, and the circuit is configured to turn off the first switch, turn on the second switch, and turn on the third switch to cause a second electric current to flow through the second switch, the series of resistive elements, and the third switch to generate the third set of reference voltages.

2. The apparatus of claim 1 in which the common gray-scale level comprises a black level.

3. The apparatus of claim 1, comprising one or more data drivers that drive data lines using the gray-scale voltages generated by the DAC, the data lines being coupled to the pixel circuits.

4. The apparatus of claim 1 in which, when the first switch is turned on, the second switch is turned off, and the third switch is turned on, the series of resistive elements provides an electrical path between a first node and a second node, the first node providing a first input voltage, the second node providing a second input voltage, the series of resistive elements dividing a voltage difference between the first input voltage and the second input voltage to generate the first set of reference voltages.

5. The apparatus of claim 1, comprising at least one of a liquid crystal display, a plasma display, an organic light emitting diode display, a field emission display, or a surface-conduction electron-emitter display, in which the display includes the circuit and the DAC.

6. The apparatus of claim 1 in which the second set of gray-scale voltage or voltages has a number of distinct voltage levels that is less than the number of distinct voltage levels in the first set of gray-scale voltages.

7. The apparatus of claim 1 in which the circuit comprises a first resistor ladder that generates a fourth set of reference voltages during the first time period and a fifth set of reference voltages during the second time period, and a second resistor ladder to further divide the fourth or fifth set of reference voltages to generate the first or second set of reference voltages, respectively, that are provided to the set of input signal lines.

8. The apparatus of claim 1 in which the gray-scale voltages derived from the second set of reference voltages consists of a positive polarity gray-scale voltage and a negative polarity gray-scale voltage that are both associated with the common gray-scale level.

9. The apparatus of claim 1 in which the first, second, and third switches control whether an electric current flows through the resistive elements connected in series to determine whether the first, second, or third set of reference voltages is provided to the DAC, and the circuit comprises a switch control signal generator that generates a switch control signal to control the on and off of the third switch, the switch control signal initially having a first voltage level that causes the third switch to be turned off, the switch control signal generator including a delay circuit that receives a power supply voltage, and after a preset period of time, changes the switch control signal to a second voltage level that causes the third switch to be turned on.

10. The apparatus of claim 1 in which the circuit is configured to turn on the first switch, turn off the second switch, and turn off the third switch to generate the second set of reference voltages.

11. The apparatus of claim 1 in which the circuit is configured to turn off the first switch, turn off the second switch, and turn on the third switch to generate the second set of reference voltages.

12. An apparatus comprising:

a circuit to generate reference voltages for use in a first state of the circuit, for generating a first set of reference voltages on a set of signal lines that are coupled to a digital-to-analog converter (DAC) in which the DAC generates gray-scale voltages based on digital pixel data and the reference voltages on the set of signal lines, and outputs the gray-scale voltages to drive pixel circuits to display respectively different gray-scale levels according to a first gamma profile, in a second state of the circuit, for generating a second set of reference voltages on the set of signal lines, in which the DAC generates one or more gray-scale voltages based on the second set of reference voltages on the set of signal lines to drive the pixel circuits to display a common gray-scale level, the second set of gray-scale voltage or voltages having a number of distinct voltage levels that is less than the number of distinct voltage levels in the first set of gray-scale voltages, and in a third state of the circuit, for generating a third set of reference voltages on the set of signal lines, in which the DAC generates gray-scale voltages based on digital pixel data and the reference voltages on the set of signal lines, and outputs the gray-scale voltages to drive pixel circuits to display respectively different gray-scale levels according to a second gamma profile;

wherein the circuit generates the first set of reference voltages, the second set of reference voltages, and the third set of reference voltages using resistive elements connected in series, and the circuit comprises one or more data drivers that drive data lines using the gray-scale voltages, the data lines being coupled to the pixel circuits, and wherein the circuit comprises a first switch, a second switch, and a third switch, and the circuit is configured to turn on the first switch, turn off the second switch, and turn on the third switch in the first state of the circuit to cause a first electric current to flow through the first switch, the series of resistive elements, and the third switch to generate the first set of reference voltages, and the circuit is configured to turn off the first switch, turn on the second switch, and turn on the third switch in the third state of the circuit to cause a second electric current to flow through the second switch, the series of resistive elements, and the third switch to generate the third set of reference voltages.

13. The apparatus of claim 12 in which the common gray-scale level comprises a black level.

14. The apparatus of claim 12 in which the circuit operates in the second state during a period after a voltage supply is provided to the data driver and before the data driver receives data signals sent from a host device.

15. The apparatus of claim 12 in which when the circuit operates in the first state, the data driver outputs a gray-scale voltage for each pixel circuit based on a data signal from a host device to cause the pixel circuit to display one of the different gray-scale levels.

16. The apparatus of claim 12 in which the DAC selects one of the signal lines based on the digital pixel data and outputs the reference voltage on the selected signal line as the gray-scale voltage.

17. The apparatus of claim 12 in which the resistive elements connected in series comprises a first series of resistive elements that generates a fourth set of reference voltages in the first state of the circuit and a fifth set of reference voltages in the second state of the circuit, and a second series of resistive elements to further divide the fourth or fifth reference voltages to generate the first or second set of reference voltages, respectively.

18. The apparatus of claim 12 in which the circuit comprises a switch control signal generator that generates a control signal to control the on and off of the third switch, the control signal initially having a first voltage level that causes the third switch to be turned off, the switch control signal generator including a delay circuit that receives a power supply voltage, and after a preset period of time, changes the control signal to a second voltage level that causes the third switch to be turned on.

19. The apparatus of claim 12 in which the circuit is configured to turn on the first switch, turn off the second switch, and turn off the third switch in the second state of the circuit to generate the second set of reference voltages.

20. The apparatus of claim 12 in which the circuit is configured to turn off the first switch, turn off the second switch, and turn on the third switch in the second state of the circuit to generate the second set of reference voltages.

21. An apparatus comprising:

a circuit to drive a pixel to a gray-scale level using an analog gray-scale voltage that is selected from among a set of analog gray-scale voltages by a digital-to-analog converter (DAC) based on received pixel data associated with the pixel, the set of analog gray-scale voltages being provided to the DAC on a group of signal lines, and change the number of different gray-scale voltages provided on the group of signal lines to the DAC from which the analog voltage can be selected during different time periods;

wherein during a first period of time, the set of analog gray-scale voltages are selected from a first set of reference voltages that have various values to allow a data driver to drive the pixel to display one of various gray-scale levels according to the digital pixel data and a first gamma profile, during a second period of time, the set of analog gray-scale voltages have values such that the data driver drives the pixel to display a common gray-scale level regardless of the digital pixel data, and during a third period of time, the set of analog gray-scale voltages are selected from a second set of reference voltages that have various values to allow the data driver to drive the pixel to display one of various gray-scale levels according to the digital pixel data and a second gamma profile, and wherein at least one of the signal lines changes from having a first gray-scale voltage suitable for driving the pixel to display one of the various gray-scale levels according to the first or second gamma profile to having a second gray-scale voltage suitable for driving the pixel to display the common gray-scale level; and wherein the circuit comprises a first switch, a second switch, and a third switch, and the circuit is configured to turn on the first switch, turn off the second switch, and turn on the third switch to cause a first electric current to flow through the first switch, resistive elements connected in series, and the third switch to generate the first set of reference voltages, the circuit is configured to turn off the first switch, turn on the second switch, and turn on the third switch to cause a second electric current to flow through the second switch, the series of resistive elements, and the third switch to generate the second set of reference voltages, and the first and second sets of reference voltages are generated using the series of resistive elements.

22. The apparatus of claim 21 in which the at least one of the signal lines changes from having the first gray-scale voltage to having the second gray-scale voltage during a period of time after a voltage supply is provided to the data driver and before the data driver receives digital pixel data from a host device.

23. The apparatus of claim 21 in which during a certain period of time, the set of analog gray-scale voltages all have a common value.

24. The apparatus of claim 21 in which during the certain period of time when the data driver drives the pixel to display a common gray-scale level, the set of analog gray-scale voltages provided to the DAC has a number of distinct voltages that is smaller than the number of distinct voltages in the set of analog gray-scale voltages provided to the DAC during other periods of time when the data driver drives the pixel to display a gray-scale level that corresponds to the digital pixel data.

25. The apparatus of claim 24 in which during the certain period of time when the data driver drives the pixel to display a common gray-scale level, the set of analog gray-scale voltages provided to the DAC has at most two distinct voltage levels, and during other periods of time when the data driver drives the pixel to display a gray-scale level that corresponds to the digital pixel data, the set of analog gray-scale voltages provided to the DAC has more than two distinct voltage levels.

26. The apparatus of claim 21 in which the circuit comprises a switch control signal generator that generates a control signal to control the on and off of the third switch, the control signal initially having a first voltage level that causes the third switch to be turned off, the switch control signal generator including a delay circuit that receives a power supply voltage, and after a preset period of time, changes the control signal to a second voltage level that causes the third switch to be turned on.

27. A display comprising:

an array of pixel circuits;

a controllable reference voltage generator to generate a first set of reference voltages during a first time period, a second reference voltage or a second set of reference voltages during a second time period, and a third set of reference voltages during a third time period, the controllable reference voltage generator comprising a voltage divider coupled to a first switch, a second switch, and a third switch that are switched when the controllable reference voltage generator switches among generating the first, second, and third set of reference voltages, the voltage divider dividing a voltage difference during the first time period to generate the first set of reference voltages, the voltage divider comprising resistive elements connected in series; and one or more data drivers to receive pixel data from a host device and to generate a first set of gray-scale voltages based on the first set of reference voltages to drive the pixel circuits to display respectively different gray-scale levels during the first time period in accordance with the pixel data and a first gamma profile, generate a second gray-scale voltage or second set of gray-scale voltages based on the second reference voltage or second set of reference voltages to drive the pixel circuits to display a common gray-scale level during the second time period, generate a third set of gray-scale voltages based on the third set of reference voltages to drive the pixel circuits to display respectively different gray-scale levels during the third time period in accordance with the pixel data and a second gamma profile, and wherein the one or more data drivers receive the first set of reference voltages on a group of signal lines during the first time period, receive the second set of reference voltages on the group of signal lines during the second time period, and receive the third set of reference voltages on the group of signal lines during the third time period;

wherein the first, second, and third switches allow a current to flow from a first voltage source and through the voltage divider during the first time period, prevent a current to flow through the voltage divider during the second time period, allow a current to flow from a second voltage source and through the voltage divider during the third time period, and the one or more data drivers switch among driving the pixel circuits to display respectively different gray-scale levels according to the first gamma profile, driving the pixel circuits to display a common gray-scale level, and driving the pixel circuits to display respectively different gray-scale levels according to the second gamma profile in response to the switching of the first, second, and third switches; and wherein at least one of the signal lines changes from having a first reference voltage suitable for driving the pixel circuits to display one of the various gray-scale levels according to the first or second gamma profile to having a second reference voltage suitable for driving the pixel circuits to display the common gray-scale level; and wherein the first, second, and third switches are configured such that the first switch is turned on, the second switch is turned off, and the third switch is turned on to cause a first electric current to flow from a first voltage source through the first switch, the series of resistive elements, and the third switch to generate the first set of reference voltages, and the first switch is turned off, the second switch is turn on, and the third switch is turned on to cause a second electric current to flow from the second voltage source through the second switch, the series of resistive elements, and the third switch to generate the third set of reference voltages.

28. The display of claim 27 in which the second set of gray-scale voltages comprises a common gray-scale voltage that corresponds to the common gray-scale level.

29. The display of claim 27 in which the second set of gray-scale voltages comprises a positive polarity gray-scale voltage and a negative polarity gray-scale voltage that both correspond to the common gray-scale level.

30. A method comprising:

generating a set of reference voltages on a set of signal lines using resistive elements connected in series, the reference voltages on the signal lines being used by one or more data drivers of a display to generate gray-scale voltages for controlling gray-scale displayed by pixels of the display;

controlling the voltage values on the signal lines to switch between a first set of reference voltages, a second reference voltage or a second set of reference voltages, and a third set of reference voltages; and switching pixels of the display between showing a common gray-scale level, showing different gray-scale levels according to a first gamma profile, and showing different gray-scale levels according to a second gamma profile in response to the switching of the voltage values on the signal lines among the first, second, and third set of reference voltages;

turning on a first switch, turning off a second switch, and turning on a third switch to cause a first electric current to flow through the first switch, the series of resistive elements, and the third switch to generate the first set of reference voltages; and turning off the first switch, turning on the second switch, and turning on the third switch to cause a second electric current to flow through the second switch, the series of resistive elements, and the third switch to generate the third set of reference voltages;

wherein at least one of the signal lines switches from having a first reference voltage suitable for driving the pixels to display the common gray-scale level to having a second reference voltage suitable for driving the pixels to display one of the various gray-scale levels according to the first or second gamma profile.

31. The method of claim 30 further comprising:

controlling reference voltages that are used by one or more data drivers of the display to generate gray-scale voltages for controlling gray-scale displayed by the pixels, the controlling comprising, during a first time period, setting the reference voltages to one or more values to cause the pixels to display a common gray-scale level independent of pixel data sent to the one or more data drivers from a host device, and during a second time period, setting the set of reference voltages to distinct values to cause the pixels to display distinct levels of gray-scale based on the pixel data sent to the one or more data drivers from the host device.

32. The display of claim 30 in which the second set of gray-scale voltages comprises a common gray-scale voltage that corresponds to the common gray-scale level.

33. The display of claim 30 in which the second set of gray-scale voltages comprises a positive polarity gray-scale voltage and a negative polarity gray-scale voltage that both correspond to the common gray-scale level.

34. The method of claim 30, comprising using a digital-to-analog converter (DAC) to select one or more particular signal lines from the set of signal lines according to digital pixel data, and generating an analog gray-scale voltage based on the voltages on the selected one or more signal lines.

35. A method comprising:

switching a display from showing an image having different gray-scale levels according to a first gamma profile to an image having a uniform gray-scale level to an image having different gray-scale levels according to a second gamma profile by switching among providing a first set of reference voltages to one or more digital-to-analog devices of the display, providing a second set of reference voltages to the one or more digital-to-analog devices, and providing a third set of reference voltages to one or more digital-to-analog devices of the display, the first, second, and third sets of reference voltages being generated using resistive elements connected in series, the one or more digital-to-analog devices generating analog gray-scale voltages used to drive pixel circuits of the display, the controlling of the reference voltages being independent of pixel data sent by a host device to the display, the switching of the display among showing an image having different gray-scale levels according to a first gamma profile, an image having a uniform gray-scale level, and an image having different gray-scale levels according to a second gamma profile being responsive to the switching among providing the first set of reference voltages, providing the second set of reference voltages, and providing the third set of reference voltages;

turning on a first switch, turning off a second switch, and turning on a third switch to cause a first electric current to flow through the first switch, the series of resistive elements, and the third switch to generate the first set of reference voltages; and turning off the first switch, turning on the second switch, and turning on the third switch to cause a second electric current to flow through the second switch, the series of resistive elements, and the third switch to generate the third set of reference voltages;

wherein the first set of reference voltages is provided to the one or more digital-to-analog devices on a group of signal lines during a first time period, the second set of reference voltages is provided to the one or more digital-to-analog devices on the group of signal lines during a second time period, and the third set of reference voltages is provided to the one or more digital-to-analog devices on the group of signal lines during a third time period, and at least one of the signal lines switches among having a first reference voltage suitable for driving the pixel circuits to display one of the various gray-scale levels according to the first gamma profile, having a second reference voltage suitable for driving the pixel circuits to display the uniform gray-scale level, and having a third reference voltage suitable for driving the pixel circuits to display one of the various gray-scale levels according to the second gamma profile during different time periods.

36. A method comprising:

providing gray-scale voltages on signal lines to a digital-to-analog converter (DAC);

for each pixel of a display, using the DAC to select one of the signal lines according to pixel data and using the gray-scale voltage on the selected signal line to determine a gray-scale level for the pixel; and switching among showing a common gray-scale level on the pixels of the display, showing distinct gray-scale levels on the pixels of the display according a first gamma profile, and showing distinct gray-scale levels on the pixels of the display according a second gamma profile in response to switching among providing a first set of gray-scale voltages on the signal lines, providing a second set of gray-scale voltages on the signal lines, and providing a third set of gray-scale voltages on the signal lines, the first, second, and third sets of reference voltages being generated using resistive elements connected in series;

turning on a first switch, turning off a second switch, and turning on a third switch to cause a first electric current to flow through the first switch, the series of resistive elements, and the third switch to generate the second set of reference voltages; and turning off the first switch, turning on the second switch, and turning on the third switch to cause a second electric current to flow through the second switch, the series of resistive elements, and the third switch to generate the third set of reference voltages;

wherein the first set of gray-scale voltages are provided to the DAC on the signal lines during a first time period, the second set of gray-scale voltages are provided to the DAC on the signal lines during a second time period, and the third set of gray-scale voltages are provided to the DAC on the signal lines during a third time period, at least one of the signal lines switches from having a first gray-scale voltage suitable for driving the pixels to display the common gray-scale level to having a second gray-scale voltage suitable for driving the pixels to display one of the distinct gray-scale levels according to the first or second gamma profile.

37. The method of claim 36 in which selecting one of the signal lines comprises selecting one of the signal lines based on pixel data sent from a host device.

38. A method comprising:

generating a first set of reference voltages, a second set of reference voltages, and a third set of reference voltages using resistive elements connected in series;

switching among generating a first color image according to a first gamma profile, generating a black image, and generating a second color image according to a second gamma profile on a display in response to switching among providing the first set of reference voltages, providing the second set of reference voltages, and providing the third set of reference voltages to one or more digital-to-analog devices of the display to generate analog gray-scale voltages for determining the gray-scale levels shown by pixels of the display;

turning on a first switch, turning off a second switch, and turning on a third switch to cause a first electric current to flow through the first switch, the series of resistive elements, and the third switch to generate the first set of reference voltages; and turning off the first switch, turning on the second switch, and turning on the third switch to cause a second electric current to flow through the second switch, the series of resistive elements, and the third switch to generate the third set of reference voltages.

39. The method of claim 38, comprising turning on the first switch, turning off the second switch, and turning off the third switch to generate the second set of reference voltages.

40. The method of claim 38, comprising turning off the first switch, turning off the second switch, and turning on the third switch to generate the second set of reference voltages.

* * * * *